US010126013B2

(12) United States Patent
Yamamoto

(10) Patent No.: US 10,126,013 B2
(45) Date of Patent: Nov. 13, 2018

(54) HEAT EXCHANGE UNIT AND AIR-CONDITIONING APPARATUS

(71) Applicant: Mitsubishi Electric Corporation, Tokyo (JP)

(72) Inventor: Keiichi Yamamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/500,583

(22) PCT Filed: Nov. 27, 2014

(86) PCT No.: PCT/JP2014/081344
§ 371 (c)(1),
(2) Date: Jan. 31, 2017

(87) PCT Pub. No.: WO2016/084185
PCT Pub. Date: Jun. 2, 2016

(65) Prior Publication Data

US 2017/0254559 A1 Sep. 7, 2017

(51) Int. Cl.
*F24F 13/22* (2006.01)
*F24F 3/044* (2006.01)
*F24F 1/00* (2011.01)

(52) U.S. Cl.
CPC ..... *F24F 13/222* (2013.01); *F24F 1/0022* (2013.01); *F24F 3/044* (2013.01);
(Continued)

(58) Field of Classification Search
CPC .. F24F 13/222; F24F 1/0022; F24F 2001/004; F24F 1/0018; F24F 13/22; F24F 1/0007
See application file for complete search history.

(56) References Cited

U.S. PATENT DOCUMENTS 5,987,909 A * 11/1999 Martin, Sr. ..... F24F 13/222 62/288
7,028,500 B2 4/2006 Jeon
(Continued)

FOREIGN PATENT DOCUMENTS

JP 52-124549 U1 9/1977
JP 63-110830 U1 7/1988
(Continued)

OTHER PUBLICATIONS

Office Action dated Oct. 17, 2017 corresponding to JP patent application No. 2016-561157 (and English machine translation attached).
(Continued)

*Primary Examiner* — Emmanuel Duke
(74) *Attorney, Agent, or Firm* — Posz Law Group, PLC

(57) ABSTRACT

A heat exchange unit includes a heat exchanger, a first drain pan, and a second drain pan. The heat exchanger is configured to cause heat to be exchanged between air and refrigerant. The first drain pan is provided so as to face the heat exchanger and has an opening through which the air flows. The second drain pan is provided so as to face the heat exchanger and is attached to the first drain pan so as to form an L shape in side view together with the first drain pan. The heat exchange unit is installed in an installation state in which the first drain pan is located below the heat exchanger or in an installation state in which the second drain pan is located below the heat exchanger. The second drain pan includes a rib on a facing surface facing the heat exchanger.

9 Claims, 14 Drawing Sheets

(52) U.S. Cl.
CPC ..... *F24F 13/22* (2013.01); *F24F 1/0007* (2013.01); *F24F 1/0018* (2013.01); *F24F 2001/004* (2013.01)

(56) References Cited

U.S. PATENT DOCUMENTS

| | | | | |
|---|---|---|---|---|
| 7,669,641 | B2 * | 3/2010 | Rembold | F24F 13/222 165/150 |
| 2005/0109053 | A1 * | 5/2005 | Eom | F24F 1/0007 62/285 |
| 2005/0132737 | A1 * | 6/2005 | Jeon | F24F 1/0007 62/298 |
| 2007/0169498 | A1 * | 7/2007 | Rios | F24F 13/222 62/285 |
| 2007/0169500 | A1 * | 7/2007 | Rios | F24F 13/222 62/285 |
| 2007/0169501 | A1 * | 7/2007 | Rios | F24F 13/222 62/286 |
| 2008/0142525 | A1 * | 6/2008 | Brouillette | F24F 13/222 220/571 |
| 2009/0249812 | A1 * | 10/2009 | Timbs | F24F 13/222 62/285 |
| 2015/0153094 | A1 * | 6/2015 | Mercer | F24F 13/222 62/276 |
| 2015/0285523 | A1 * | 10/2015 | Yokoyama | F24F 13/22 165/121 |

FOREIGN PATENT DOCUMENTS

| | | | |
|---|---|---|---|
| JP | 11-002422 | A | 1/1999 |
| JP | 2001-201080 | A | 7/2001 |
| JP | 2006-226658 | A | 8/2006 |
| JP | 2013-204874 | A | 10/2013 |

OTHER PUBLICATIONS

International Search Report of the International Searching Authority dated Feb. 24, 2015 for the corresponding International application No. PCT/JP2014/081344 (and English translation).
Japanese office action dated Jun. 6, 2017, issued in corresponding with JP patent No. 2016-561157 (an English translation).

* cited by examiner

HEAT EXCHANGE UNIT AND AIR-CONDITIONING APPARATUS

CROSS REFERENCE TO RELATED APPLICATION

This application is a U.S. national stage application of PCT/JP2014/081344 filed on Nov. 27, 2014, the contents of which are incorporated herein by reference.

TECHNICAL FIELD

The present invention relates to a heat exchange unit that allows heat to be exchanged between air and refrigerant and also relates to an air-conditioning apparatus that includes the heat exchange unit.

BACKGROUND ART

As a related-art air-conditioning apparatus equipped with a heat exchange unit, there has been a known air-conditioning apparatus that includes a floor-type indoor unit having a placement surface that is changed when the indoor unit is placed on a floor. For this air-conditioning apparatus, wind blowing directions are considered. The placement surface placed on the floor is changed in accordance with a wind direction when the wind direction is, for example, upward blowing, horizontal blowing, or downward blowing. Furthermore, a drain pan that receives water droplets falling from the heat exchanger provided in the air-conditioning apparatus has a structure that is usable when the placement surface of the air-conditioning apparatus is changed. For such an air-conditioning apparatus, characteristics such as water drainage performance, strength, heat insulation performance, and work efficiency of attaching a heat insulating material are considered.

For example, Patent Literature 1 discloses an air-conditioning apparatus that includes a floor-type indoor unit as described above. According to Patent Literature 1, a drain pan is formed of resin, and to improve the strength of the drain pan, a rib is provided on a surface of the drain pan opposite to a surface of the drain pan facing a heat exchanger.

CITATION LIST

Patent Literature

Patent Literature 1: U.S. Pat. No. 7,028,500

SUMMARY OF INVENTION

Technical Problem

Typically, the heat insulating material is bonded to the rear surface of the drain pan to prevent condensation. In the air-conditioning apparatus disclosed in Patent Literature 1, the rib is provided on the rear surface. In this case, bonding of the heat insulating material to a region where the rib is disposed is avoided. However, when the number of ribs provided on the rear surface is increased to further improve the strength of the drain pan, bonding of the heat insulating material to a region or regions where the added rib or the added ribs are disposed is also avoided. This increases the number of divided pieces of the insulating material, thereby degrading work efficiency of the bonding of the heat insulating material.

The present invention has been made in view of the above-described problem and provides a heat exchange unit for which work efficiency of bonding of a heat insulating material is improved while the strength of a drain pan is improved. The present invention also provides an air-conditioning apparatus equipped with this heat exchange unit.

Solution to Problem

A heat exchange unit of an embodiment of the present invention includes a heat exchanger, a first drain pan, and a second drain pan. The heat exchanger is configured to cause heat to be exchanged between air and refrigerant. The first drain pan is provided so as to face the heat exchanger and has an opening through which the air flows. The second drain pan is provided so as to face the heat exchanger and is attached to the first drain pan so as to form an L shape in side view together with the first drain pan. The heat exchange unit is installed in an installation state in which the first drain pan is located below the heat exchanger or in an installation state in which the second drain pan is located below the heat exchanger. The second drain pan includes a rib on a facing surface facing the heat exchanger.

Advantageous Effects of Invention

The second drain pan of the heat exchange unit of the embodiment of the present invention includes the rib on the facing surface that faces another surface of the heat exchanger. Thus, the work efficiency of the bonding of the heat insulating material for the heat exchange unit can be improved while the strength of the second drain pan of the heat exchange unit is improved.

DESCRIPTION OF EMBODIMENTS

Figure 1:
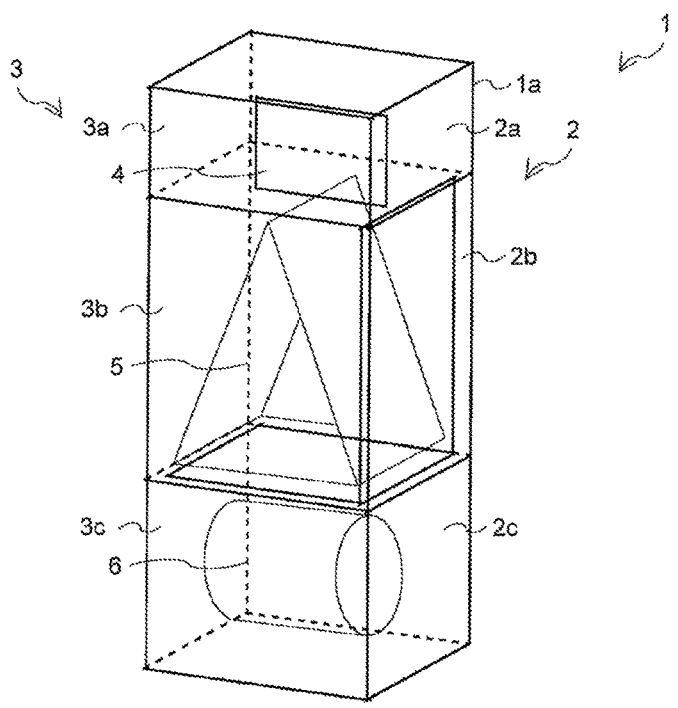
FIG. 1 is a perspective view of an air-conditioning apparatus 1 according to Embodiment 1 of the present invention.

Embodiment of a heat exchange unit and an air-conditioning apparatus of the present invention will be described with reference to the drawings. It should be understood that Embodiment to be described below does not limit the present invention. Furthermore, the relationships between sizes of elements illustrated in the drawings including FIG. 1 referred to below may be different from those of the actual elements.

Embodiment 1

Figure 2:
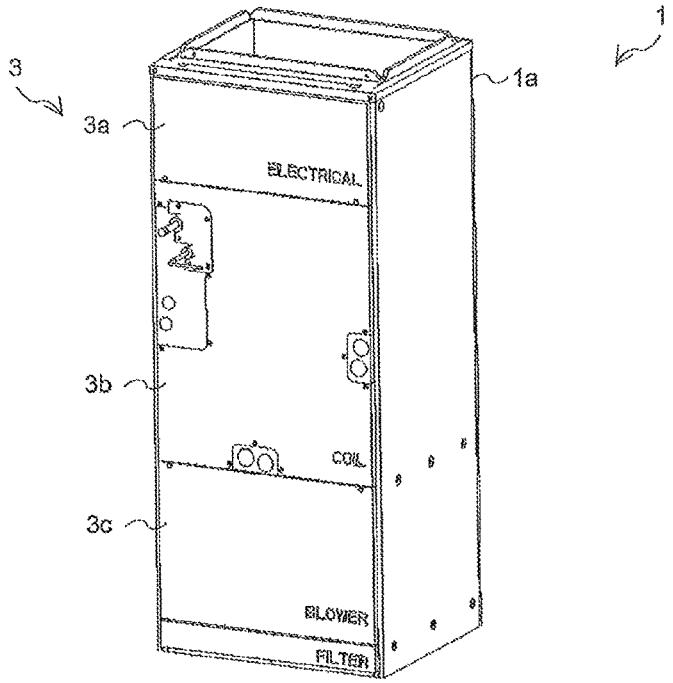
FIG. 2 is a perspective view of the air-conditioning apparatus 1 according to Embodiment 1 of the present invention.

FIGS. 1 and 2 are perspective views of an air-conditioning apparatus 1 according to Embodiment 1 of the present invention. The air-conditioning apparatus 1 is described referring to FIGS. 1 and 2. As illustrated in FIGS. 1 and 2, the air-conditioning apparatus 1 includes a heat exchange unit 5. The air-conditioning apparatus 1 also includes a housing 1*a*, an air-sending unit 6, and a control unit 4.

The housing 1*a* has an elongated box shape having chambers 2 therein. The control unit 4, the heat exchange unit 5, and the air-sending unit 6 are removably housed in the chambers 2. The chambers 2 include three chambers, that is, a first chamber 2*a*, a second chamber 2*b*, and a third chamber 2*c*. The first chamber 2*a* is an uppermost chamber. The second chamber 2*b* is provided below the first chamber 2*a*. The third chamber 2*c* being a lowermost chamber is provided below the second chamber 2*b*. The first chamber 2*a* houses the control unit 4, the second chamber 2*b* houses the heat exchange unit 5, and the third chamber 2*c* houses the air-sending unit 6. The housing 1*a* includes openable doors 3 that close the chambers 2. A first door 3*a*, a second door 3*b*, and a third door 3*c* are respectively attached to the first chamber 2*a*, the second chamber 2*b*, and the third chamber 2*c*. When performing, for example, maintenance on the air-conditioning apparatus 1, the doors 3 are opened to draw the control unit 4, the heat exchange unit 5, and the air-sending unit 6 from the housing 1*a*. Furthermore, the top and the bottom of each of the first chamber 2*a*, the second chamber 2*b*, and the third chamber 2*c* are open.

Figure 3:
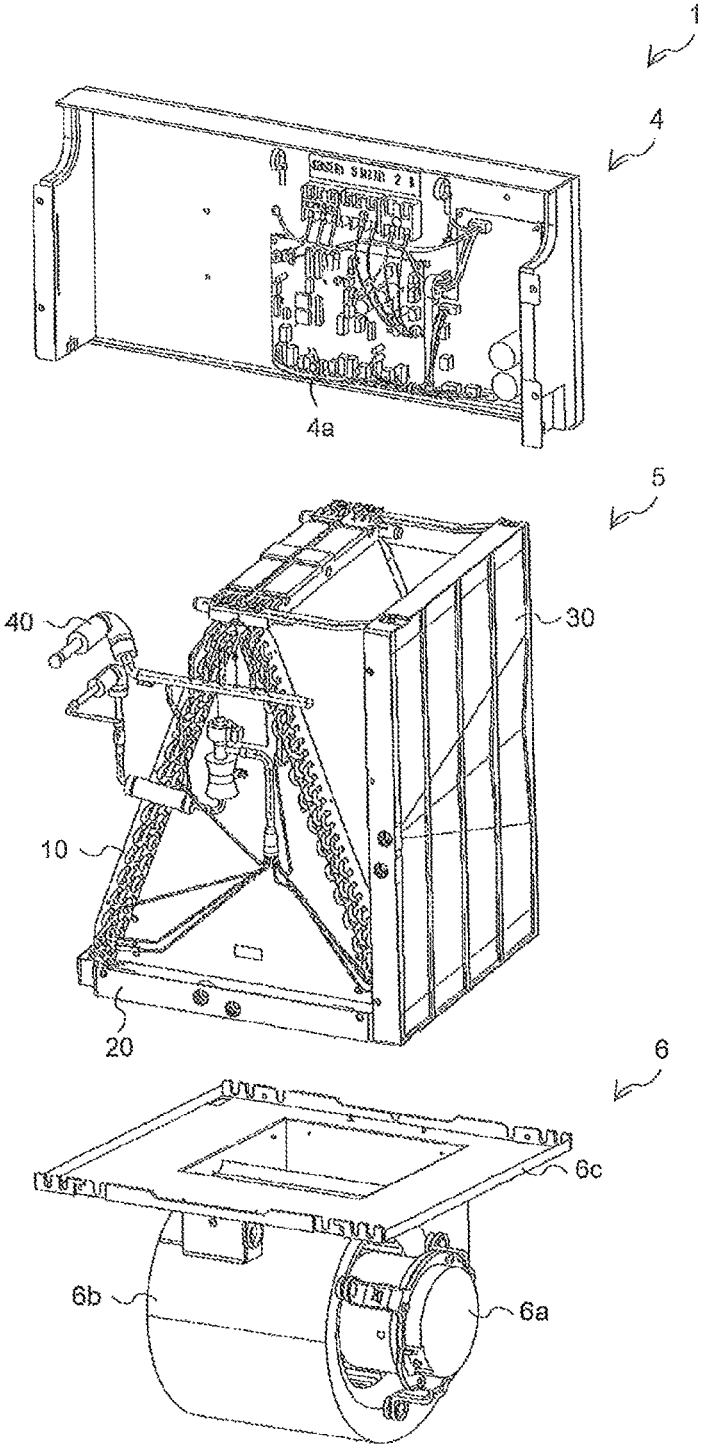
FIG. 3 includes perspective views of the structure of the air-conditioning apparatus 1 according to Embodiment 1 of the present invention.

FIG. 3 includes perspective views of the structure of the air-conditioning apparatus 1 according to Embodiment 1 of the present invention. As illustrated in FIG. 3, the control unit 4 includes components including a plurality of control boards 4*a*. The control unit 4 controls operation of the air-conditioning apparatus 1. The components including the control boards 4*a* are installed on the first door 3*a* side of the first chamber 2*a* (see FIG. 1). The heat exchange unit 5 allows heat exchange between air and refrigerant.

Furthermore, the air-sending unit 6 sends air. The air-sending unit 6 includes a motor 6*a*, a cylindrical fan 6*b* provided at an outer circumference of the motor 6*a*, and a fan plate 6*c* that is mounted on the upper side of the fan 6*b* and has a rectangular frame shape having an opening through which the air flows. Part of the motor 6*a* projects from one side portion of the fan 6*b*. The fan plate 6*c* is symmetric about a center line extending perpendicularly to the depth direction of the housing 1*a*. This allows the air-sending unit 6 to be installed in a horizontally half turned state in the third chamber 2*c*.

Figure 4:
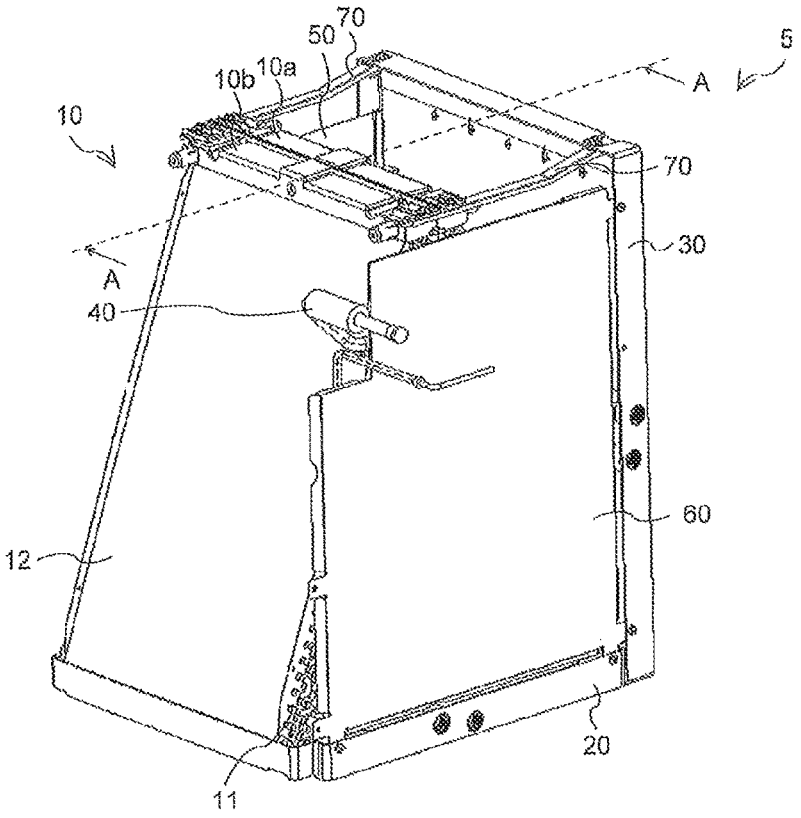
FIG. 4 is a perspective view of a heat exchange unit 5 according to Embodiment 1 of the present invention.
Figure 5:
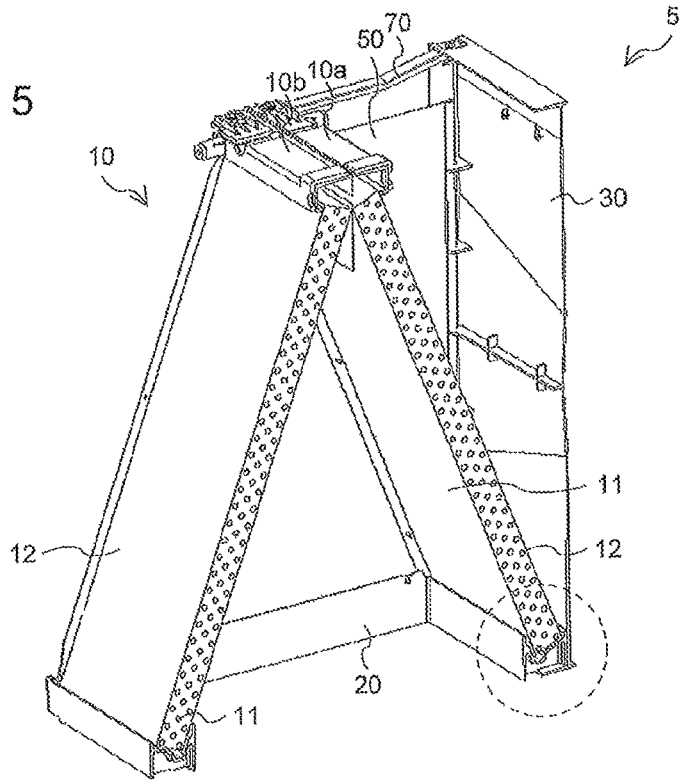
FIG. 5 is a perspective view of the heat exchange unit 5 according to Embodiment 1 of the present invention.

Next, the heat exchange unit 5 is described in detail. FIG. 4 is a perspective view of the heat exchange unit 5 according to Embodiment 1 of the present invention. FIG. 5 is a perspective view of the heat exchange unit 5 according to Embodiment 1 of the present invention, illustrating a sectional view taken along line A-A of FIG. 4. As illustrated in FIGS. 4 and 5, the heat exchange unit 5 includes a heat exchanger 10, a first drain pan 20, and a second drain pan 30. The heat exchange unit 5 also includes a refrigerant pipe 40, a first sheet metal 50, a second sheet metal 60, and an attachment sheet metal 70.

The heat exchanger 10 is a fin-tube type heat exchanger in which a plurality of tubes 11 that allow the refrigerant to flow therethrough are inserted through a plurality of heat transfer fins 12 spaced apart from one another. The heat exchanger 10 includes a first heat exchange subunit 10*a* and a second heat exchange subunit 10*b*. The first heat exchange subunit 10*a* and the second heat exchange subunit 10*b* are inclined so as to face each other and have upper end portions that are in contact with each other. In the heat exchanger 10, the air flows between the heat transfer fins 12, thereby exchanging heat with the refrigerant flowing through the tubes 11.

Figure 6:
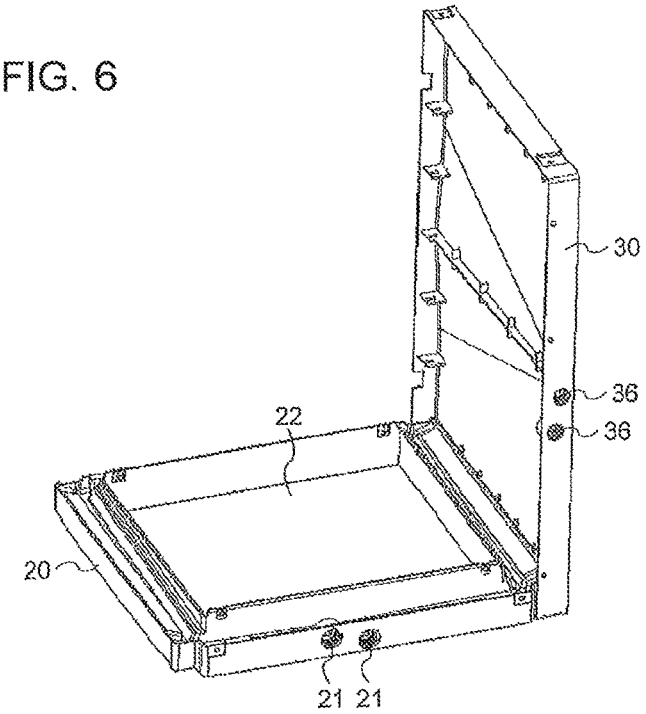
FIG. 6 is a perspective view of a first drain pan 20 and a second drain pan 30 according to Embodiment 1 of the present invention.
Figure 7:
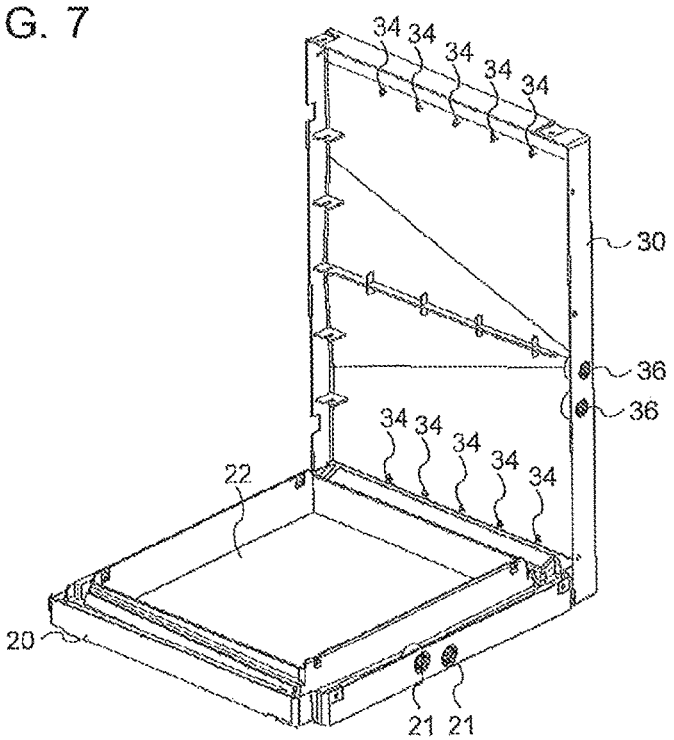
FIG. 7 is a perspective view of the first drain pan 20 and the second drain pan 30 according to Embodiment 1 of the present invention.

FIGS. 6 and 7 are perspective views of the first drain pan 20 and the second drain pan 30 according to Embodiment 1 of the present invention. As illustrated in FIGS. 6 and 7, the first drain pan 20 and the second drain pan 30 are provided so as to form an L shape in side view in the heat exchanger 10. The first drain pan 20 has a rectangular frame shape and is provided so as to cover one surface, for example, the bottom surface, of the heat exchanger 10. Specifically, a lower end portion of the second heat exchange subunit 10*b* is placed on one side portion of the first drain pan 20, and a lower end portion of the first heat exchange subunit 10*a* is placed on the other side portion of the first drain pan 20 facing the one side portion. With this structure, the first drain pan 20 receives water droplets falling from the heat exchanger 10.

Also in the first drain pan 20, first water outlets 21 are provided in a side portion between the one side portion and the other side portion. Two of the first water outlets are provided. The water droplets falling on the first drain pan 20 are drained through the first water outlets 21. Furthermore, a central portion of the first drain pan 20 is opened. This opening serves as an opening 22. The air flows through the opening 22. The first drain pan 20 is symmetric about a center line extending perpendicularly to the width direction of the housing 1*a*. Glass fiber is used for the first drain pan 20. This ensures the strength of the first drain pan 20.

Figure 8:
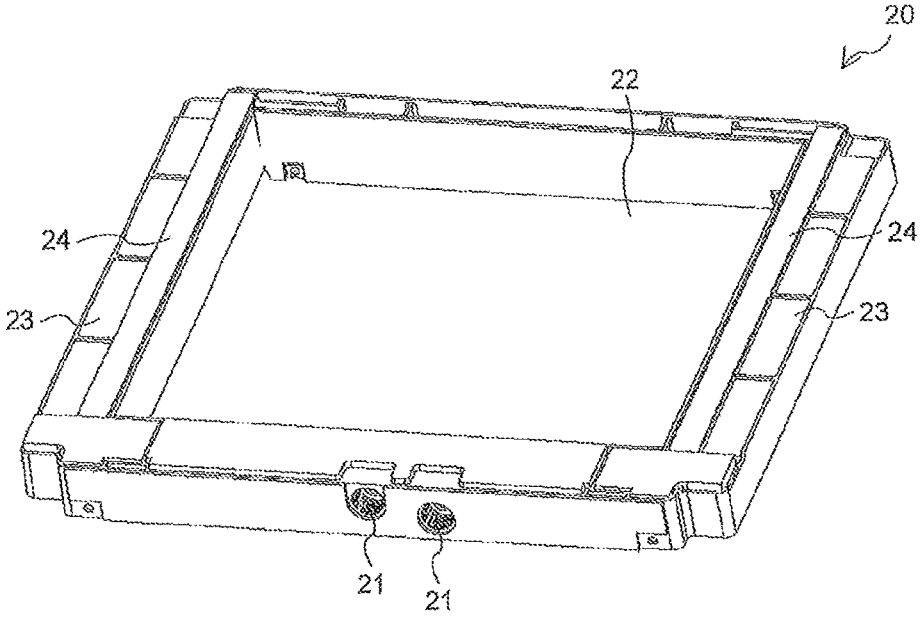
FIG. 8 is a perspective view of the first drain pan 20 according to Embodiment 1 of the present invention.

FIG. 8 is a perspective view of the first drain pan 20 according to Embodiment 1 of the present invention when the first drain pan 20 is viewed from the lower side of the air-conditioning apparatus 1. As illustrated in FIG. 8, styrene 23 is provided on a rear surface 30*b* of the first drain pan 20. The rear surface 30*b* is opposite to a surface facing one surface of the heat exchanger 10. Furthermore, a heat insulating materials 24 are bonded on inner peripheral sides of the styrene 23 in the first drain pan 20. The styrene 23 and the heat insulating materials 24 have a function of blocking heat generated by the heat exchanger 10.

The rear surface of the first drain pan 20 is placed on and in contact with a sheet metal that separates the second chamber 2*b* and the third chamber 2*c* from each other. The styrene 23 and the heat insulating materials 24 are located between the first drain pan and the second drain pan (see FIG. 12). Accordingly, neither the styrene 23 nor the heat insulating materials 24 are in contact with the sheet metal. This suppresses removal, scratches, or the like occurring due to contact of the styrene 23 or the heat insulating materials 24 with the sheet metal. Since neither the styrene 23 nor the heat insulating materials 24 are in contact with the sheet metal, it is not required to consider the occurrences of the removal, scratches, or the like. This eliminates inconvenience that could otherwise occur when the heat exchange unit 5 is removed from the housing 1*a*.

Figure 9:
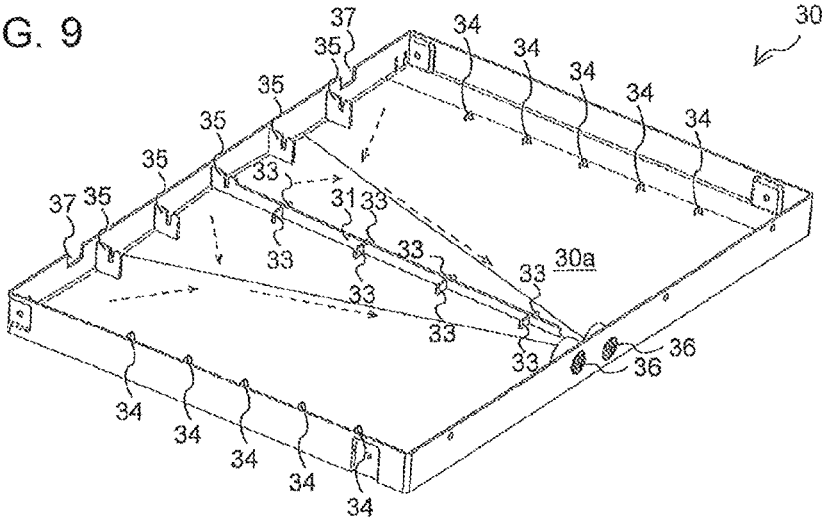
FIG. 9 is a perspective view of the second drain pan 30 according to Embodiment 1 of the present invention, FIG. 10 includes views illustrating an inclined surface of the second drain pan 30 according to Embodiment 1 of the present invention.

FIG. 9 is perspective view of the second drain pan 30 according to Embodiment 1 of the present invention when the second drain pan 30 is viewed from the heat exchanger 10 side. As illustrated in FIG. 9, the second drain pan 30 has a rectangular shape and has edge portions extending toward the heat exchanger 10 side. The second drain pan 30 is provided so as to cover the other surface, for example, a side surface, of the heat exchanger 10. Furthermore, the second drain pan 30 includes on the facing surface 30*a* a rib 31 that projects from a facing surface 30*a* that faces the other surface of the heat exchanger 10. The rib 31 extends in one direction perpendicular to a height direction of the heat exchanger 10. Furthermore, the second drain pan 30 includes auxiliary ribs 33 that project from the facing surface 30*a* and intersect the rib 31. The auxiliary ribs 33 extend in a direction perpendicular to the rib 31. The length of the auxiliary ribs 33 may be smaller than the length of the rib 31. Although eight auxiliary ribs 33 are provided according to Embodiment 1, the number of the auxiliary ribs 33 may be changed as appropriate.

The second drain pan 30 further includes temporal securing ribs 34. The temporal securing ribs 34 project from the facing surface 30*a* and temporally secure the first drain pan 20 while the second drain pan 30 is being attached to the first drain pan 20 (see FIG. 7). According to Embodiment 1, the temporal securing ribs 34 are provide in an upper portion and a lower portion in the height direction of the heat exchanger 10, and five temporal securing ribs 34 are provided in each of the upper portion and the lower portion. However, the positions and the number of the temporal securing ribs 34 may be changed as appropriate.

Furthermore, the second drain pan 30 includes sheet metal ribs 35 provided in one side portion. The first sheet metal 50 is fitted into the sheet metal ribs 35. Although five sheet metal ribs 35 are provided according to Embodiment 1, the number of the sheet metal ribs 35 may be changed as appropriate. Furthermore, the second drain pan 30 has two second water outlets 36 provided in the other side portion. The positions where the second water outlets 36 are provided are along a line that passes through the rib 31. Water droplets falling on the second drain pan 30 are drained through the second water outlets 36. The second water outlets 36 are located on the second door 3*b* side in the second chamber 2*b* of the housing 1*a*. Furthermore, the second drain pan 30 has a cut 37 formed by a cut in the one side portion. When the second water outlets 36 are clogged, water stored in the second drain pan 30 is drained through the cut 37. This suppresses the occurrence of a situation in which the components including the control boards 4*a* provided on the first door 3*a* side become wetted with water leaking from the second water outlet 36 side.

Figure 10:
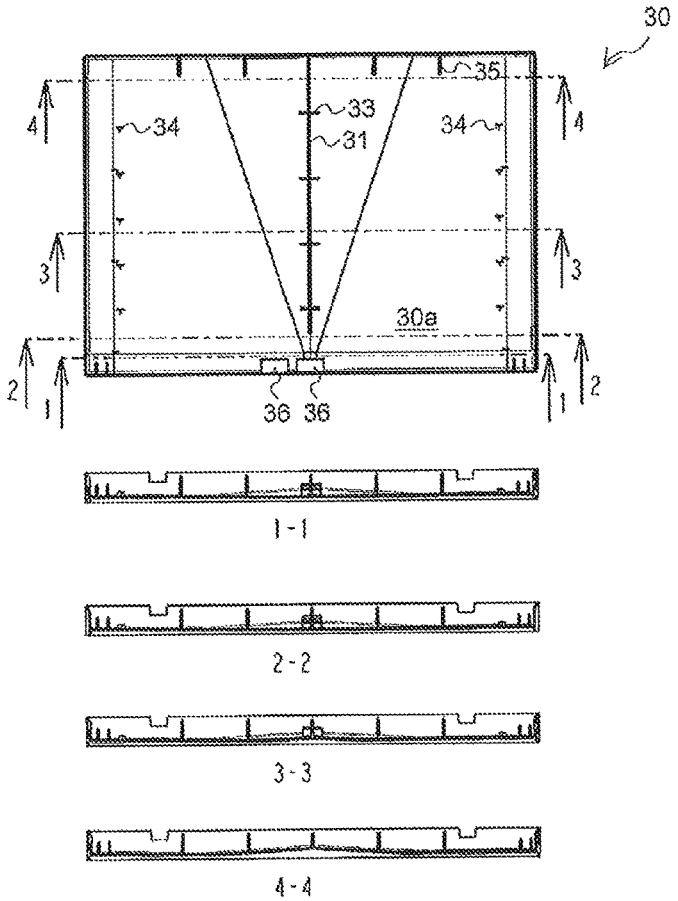

FIG. 10 includes views illustrating an inclined surface of the second drain pan 30 according to Embodiment 1 of the present invention. As illustrated in FIG. 10, the facing surface 30*a* of the second drain pan 30 is inclined. In an installation state in which the second drain pan 30 is located below the heat exchanger 10, the rib 31 is configured so as to be gradually descending from the rib 31. Furthermore, the facing surface 30*a* is inclined such that the height of the facing surface 30*a* is increased at both side end portions and a central portion and gradually reduced from the sheet metal rib 35 side toward the second water outlet 36 side. That is, in the installation state in which the second drain pan 30 is located below the heat exchanger 10, the rib 31 extends toward the one direction and is inclined so as to gradually descend. In the installation state in which the second drain pan 30 is located below the heat exchanger 10, the second water outlets 36 are provided on the one direction side to allow the water droplets on the second drain pan 30 to be drained therethrough. Thus, the water droplets falling on the second drain pan 30 are directed toward the second water outlets 36 along the inclined surface and drained through the second water outlets 36 (dashed arrows of FIG. 9). The angle by which the inclined surface is inclined is, for example, 2 degrees or larger. With this inclination angle, the water is smoothly drained even when the second drain pan 30 is inclined by about 1 degree. The second drain pan 30 is symmetric about a center line. Glass fiber is used for the second drain pan 30. This ensures the strength of the second drain pan 30.

Figure 11:
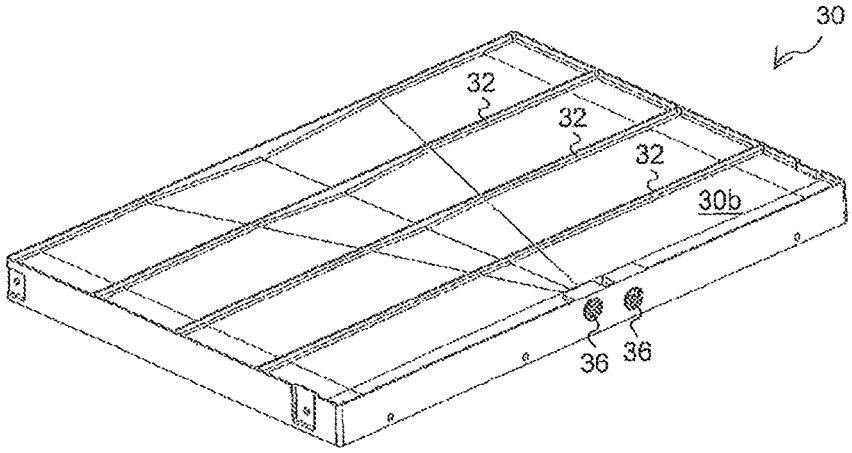
FIG. 11 is a perspective view of the second drain pan 30 according to Embodiment 1 of the present invention.

FIG. 11 is a perspective view of the second drain pan 30 according to Embodiment 1 of the present invention when the second drain pan 30 is viewed from a lateral side of the air-conditioning apparatus 1. As illustrated in FIG. 11, the second drain pan 30 includes rear ribs 32 that project from the rear surface 30*b* back side of the facing surface 30*a*. When viewed through the facing surface 30*a* from the facing surface 30*a* side, the rear ribs 32 are disposed at different positions from the rib 31 provided on the facing surface 30*a*. For example, the rear ribs 32 intersect the rib 31 when viewed through the facing surface 30*a* from the facing surface 30*a* side. Although three rear ribs 32 are provided according to Embodiment 1, the number of the rear ribs 32 may be changed as appropriate.

Figure 12:
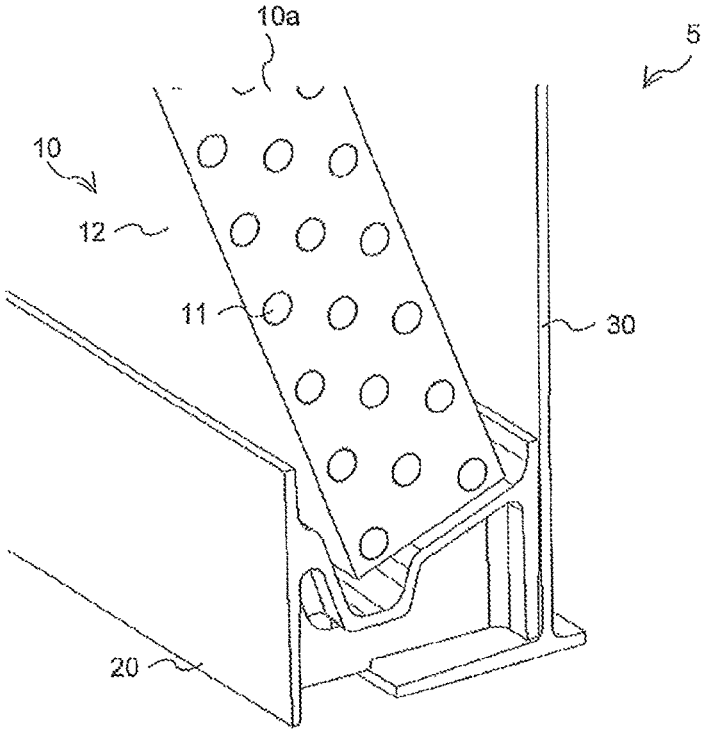
FIG. 12 is a sectional view of the heat exchange unit 5 according to Embodiment 1 of the present invention.

FIG. 12 is a sectional view of the heat exchange unit 5 according to Embodiment 1 of the present invention, illustrating an enlarged view of part surrounded by a dotted line of FIG. 5. As illustrated in FIG. 12, the second drain pan 30 is attached to the first drain pan 20. According to Embodiment 1, the second drain pan 30 is detachably attached to the one side portion of the first drain pan 20. For example, the lower portion of the second drain pan 30 is attached to a portion of the first drain pan 20 where the lower end portion of the first heat exchange subunit 10*a* is placed.

Figure 13:
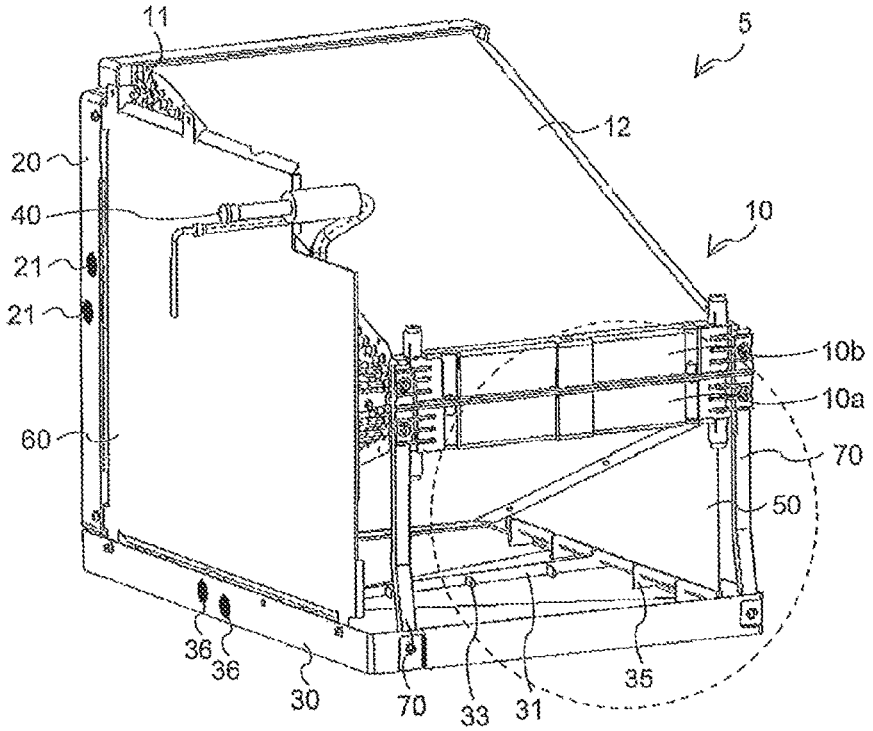
FIG. 13 is a perspective view of the heat exchange unit 5 according to Embodiment 1 of the present invention.

FIG. 13 is a perspective view of the heat exchange unit 5 according to Embodiment 1 of the present invention. As illustrated in FIGS. 4 and 13, the refrigerant pipe 40 extends from the heat exchanger 10 in the one direction. The refrigerant flows through the refrigerant pipe 40. The one direction refers to a direction directed toward a side where the second water outlets 36 are provided in the second drain pan 30.

Figure 14:
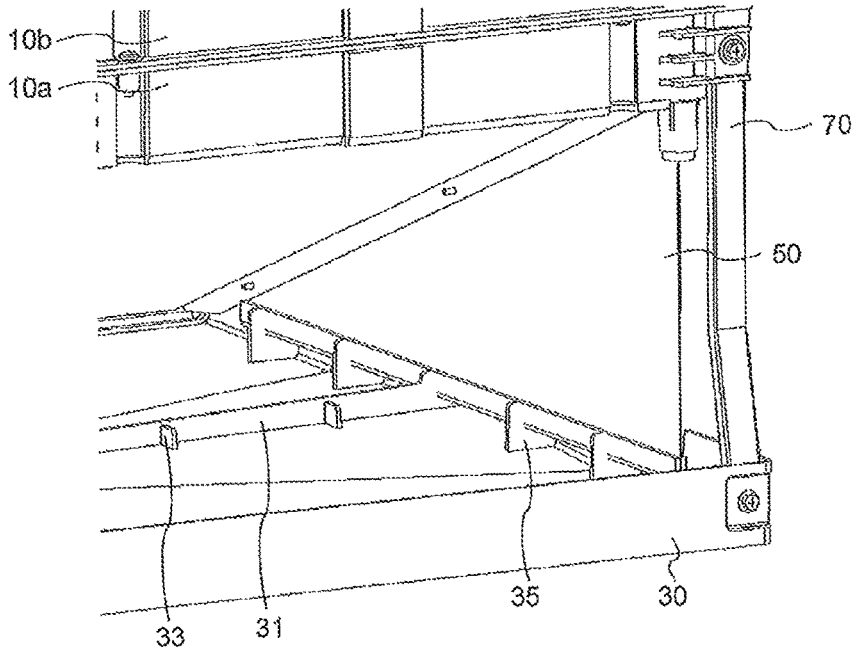
FIG. 14 is a perspective view of the heat exchange unit 5 according to Embodiment 1 of the present invention.

FIG. 14 is a perspective view of the heat exchange unit 5 according to Embodiment 1 of the present invention, illustrating an enlarged view of part of FIG. 13 surrounded by a dotted line. As illustrated in FIGS. 13 and 14, the first sheet metal 50 has a rectangular shape and is fitted into the sheet metal ribs 35 on the second drain pan 30. The first sheet metal 50 suppresses splashing of the water droplets falling from the heat exchanger 10 to the outside of the second drain pan 30. Swinging of the first sheet metal 50 due to, for example, wind is suppressed by fitting the first sheet metal 50 into the sheet metal ribs 35.

As illustrated in FIG. 13, the second sheet metal 60 has a rectangular shape and is provided on the second water outlet 36 side, that is, the one direction side to which the refrigerant pipe 40 extends in the second drain pan 30. The second sheet metal 60 reduces the likelihood of dew that splashes from, for example, the heat exchanger 10 or the refrigerant pipe 40 reaching the outside of the second drain pan 30. The second sheet metal 60 receives the dew splashing from, for example, the heat exchanger 10 or the refrigerant pipe 40 and allows the dew to move therealong. Thus, the second sheet metal 60 causes the dew to fall on the first drain pan 20 or the second drain pan 30.

As illustrated in FIG. 13, the attachment sheet metal 70 is a bar-shaped member having one end and the other end. The one end of the attachment sheet metal 70 is attached to a portion where the upper portion of the first heat exchange subunit 10*a* and the upper portion of the second heat exchange subunit 10*b* are in contact with each other. The other end of the attachment sheet metal 70 is attached to an upper portion of the second drain pan 30. As described above, the attachment sheet metal 70 is used to attach the second drain pan 30 to the heat exchanger 10.

Figure 15:
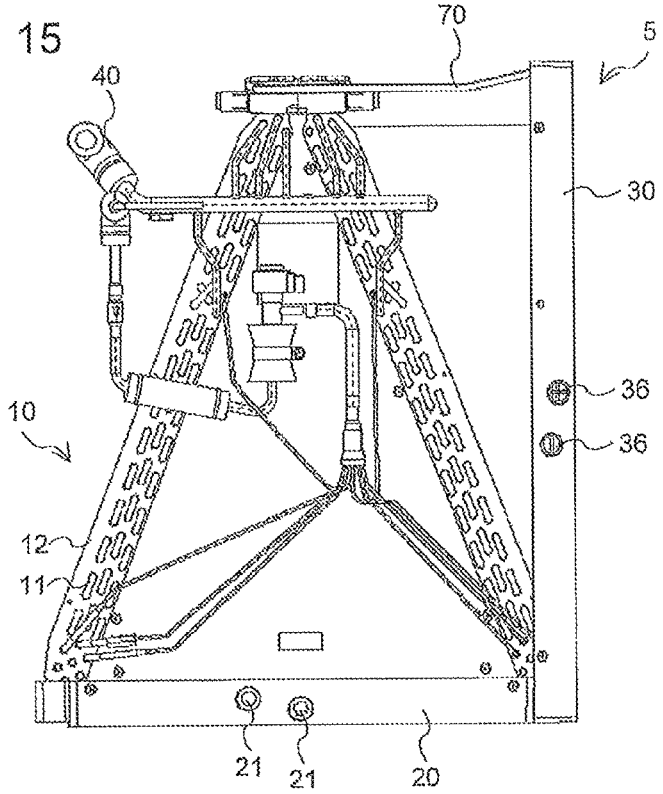
FIG. 15 is a side view of the heat exchange unit 5 according to Embodiment 1 of the present invention.
Figure 16:
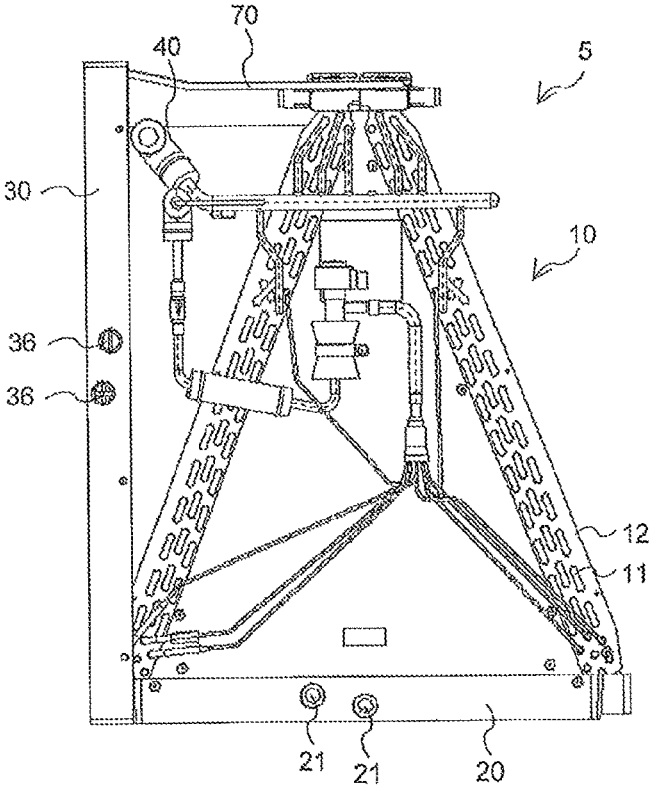
FIG. 16 is a side view of the heat exchange unit 5 according to Embodiment 1 of the present invention.

Next, attachment and detachment of the second drain pan 30 are described. FIGS. 15 and 16 are side views of the heat exchange unit 5 according to Embodiment 1 of the present invention. As illustrated in FIG. 15, a lower end portion of the second drain pan 30 is attached to the one side portion of the first drain pan 20, and an upper end portion of the second drain pan 30 is attached to the attachment sheet metal 70. From this state, the second drain pan 30 is removed from the one side portion of the first drain pan 20 and the attachment sheet metal 70. After that, the upper end portion of the second drain pan 30 is attached to the other side portion of the first drain pan 20, and the lower end portion of the second drain pan 30 is attached to the attachment sheet metal 70. In so doing, the attachment sheet metal 70 is attached to the heat exchanger 10 with the direction thereof reversed in the width direction of the heat exchanger 10. Thus, in both FIGS. 15 and 16, the first water outlets 21 of the first drain pan 20 and the second water outlets 36 of the second drain pan 30 face in the one direction in which the refrigerant pipe 40 extends. As has been described, the first drain pan 20 and the second drain pan 30 are symmetric about the center lines. This allows the attachment in either of manners illustrated in FIGS. 15 and 16. Furthermore, the second drain pan 30 includes the temporal securing ribs 34 in both the upper portion and the lower portion. This allows the attachment in either of manners illustrated in FIGS. 15 and 16 (see FIG. 7). As described above, one side portion of the second drain pan 30 is detachably attached to the one side portion of the first drain pan 20, and the other side portion of the second drain pan 30 facing the one side portion of the second drain pan 30 is detachably attached to the other side portion of the first drain pan 20 facing the one side portion of the first drain pan 20. To realize this, the one side-portion side and the other side-portion side are symmetric with each other in the first drain pan 20, and the one side-portion side and the other side-portion side are symmetric with each other in the second drain pan 30.

Figure 17:
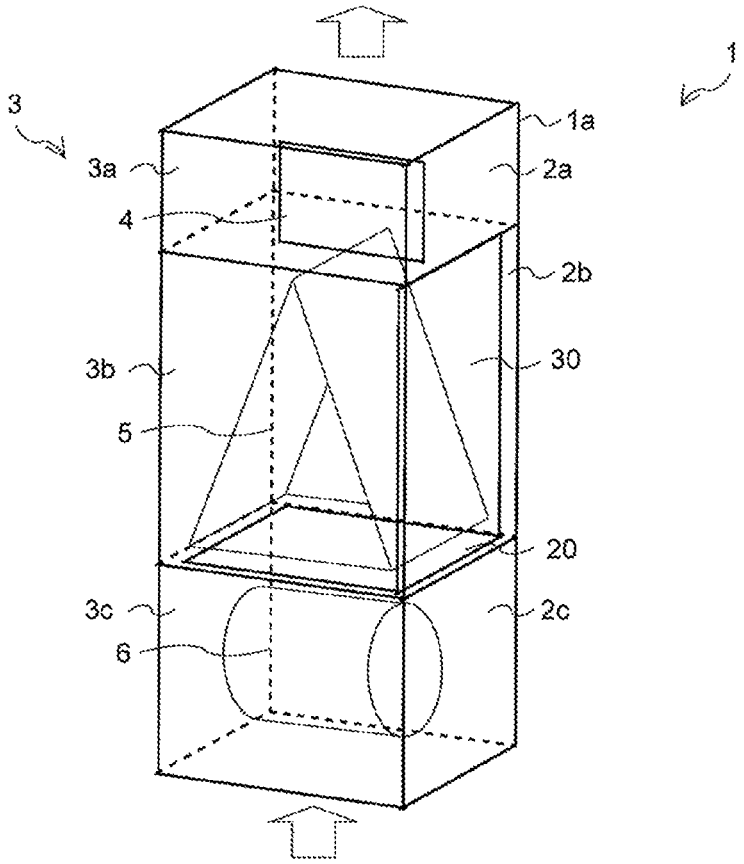
FIG. 17 is a perspective view of the air-conditioning apparatus 1 according to Embodiment 1 of the present invention.
Figure 18:
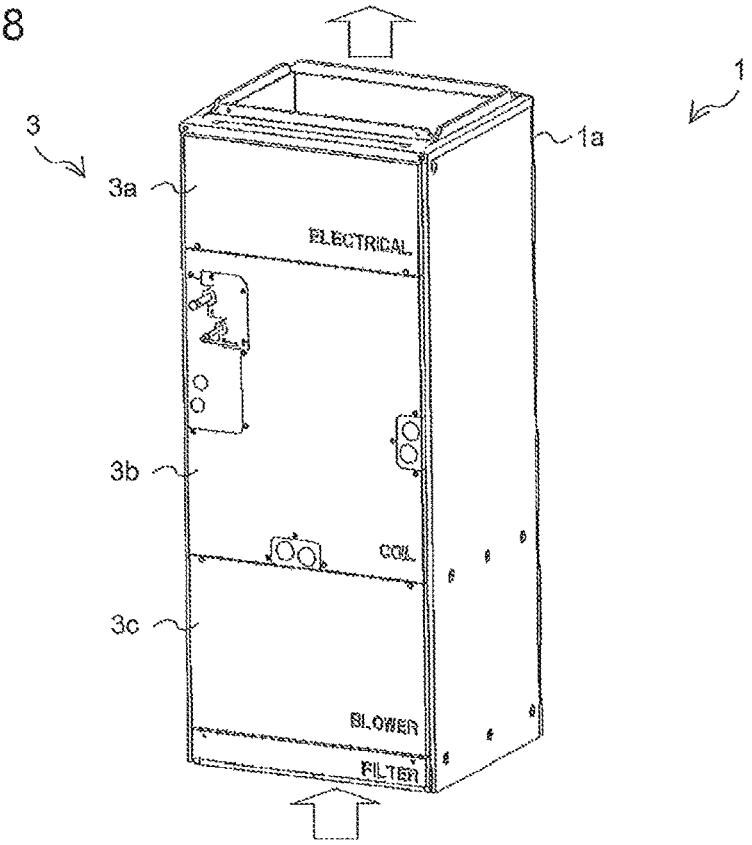
FIG. 18 is a perspective view of the air-conditioning apparatus 1 according to Embodiment 1 of the present invention.
Figure 19:
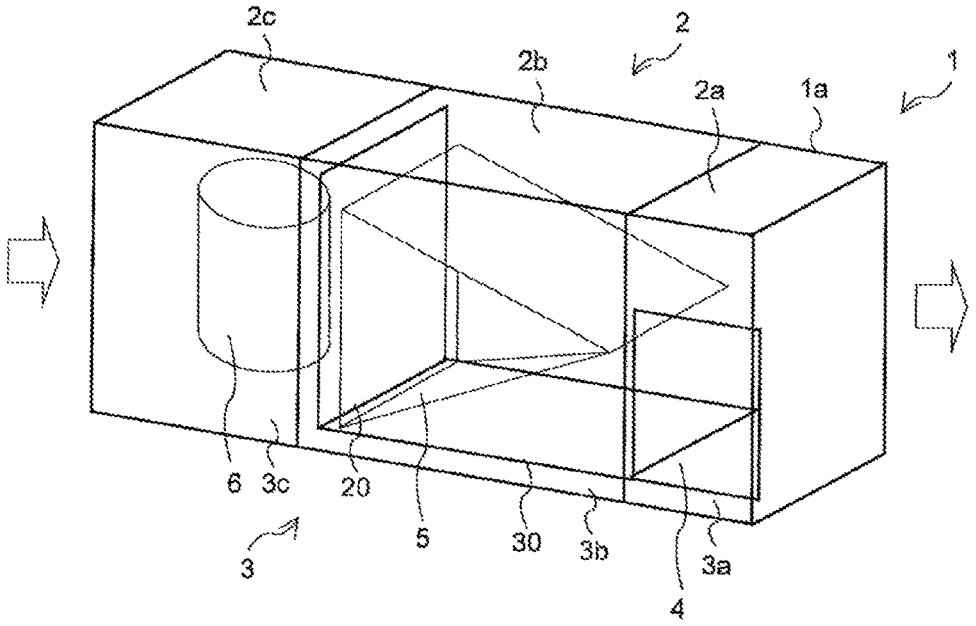
FIG. 19 is a perspective view of the air-conditioning apparatus 1 according to Embodiment 1 of the present invention.
Figure 20:
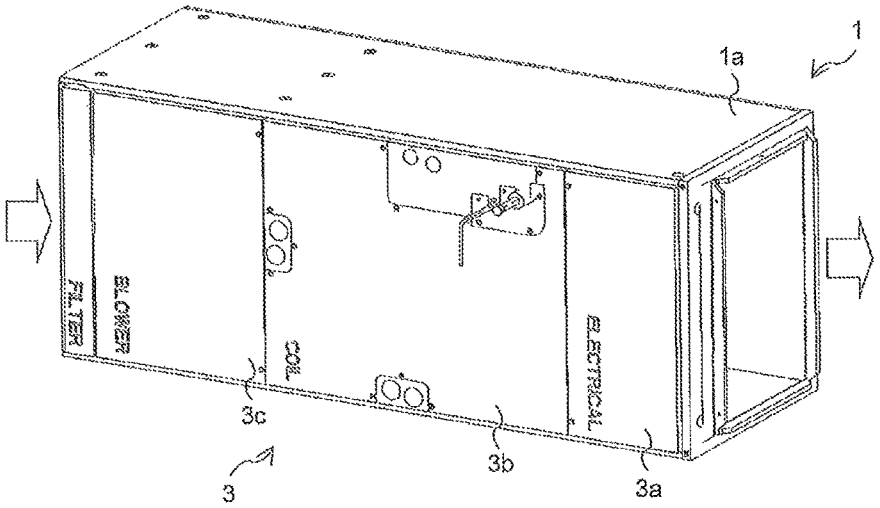
FIG. 20 is a perspective view of the air-conditioning apparatus 1 according to Embodiment 1 of the present invention.
Figure 21:
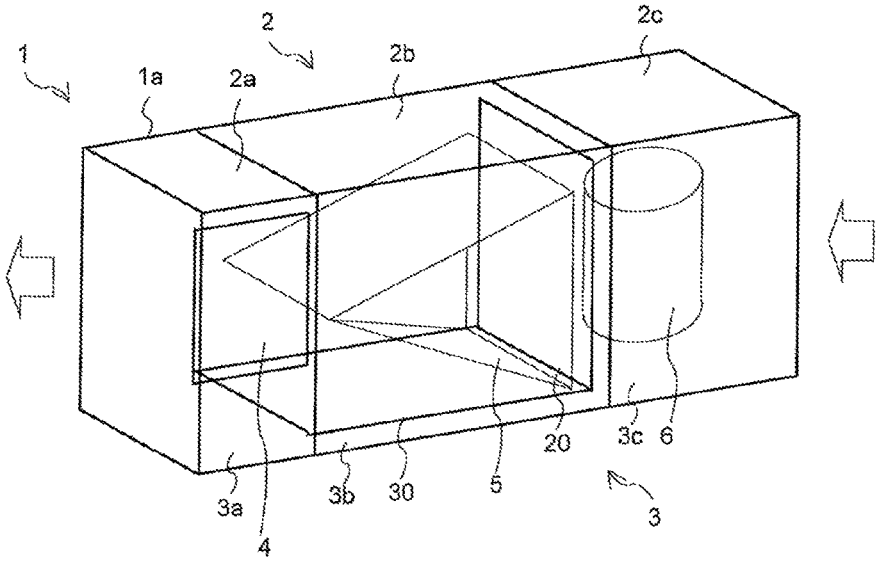
FIG. 21 is a perspective view of the air-conditioning apparatus 1 according to Embodiment 1 of the present invention.
Figure 22:
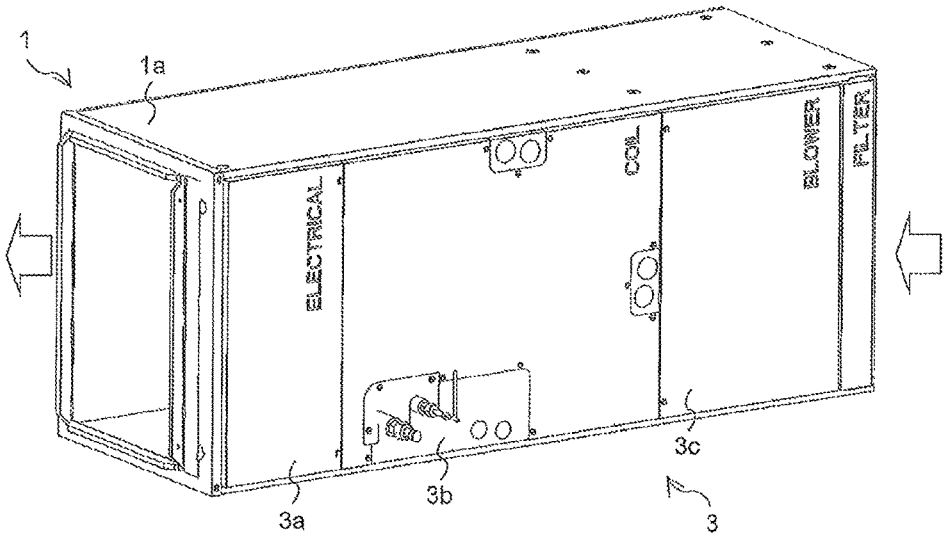
FIG. 22 is a perspective view of the air-conditioning apparatus 1 according to Embodiment 1 of the present invention.
Figure 23:
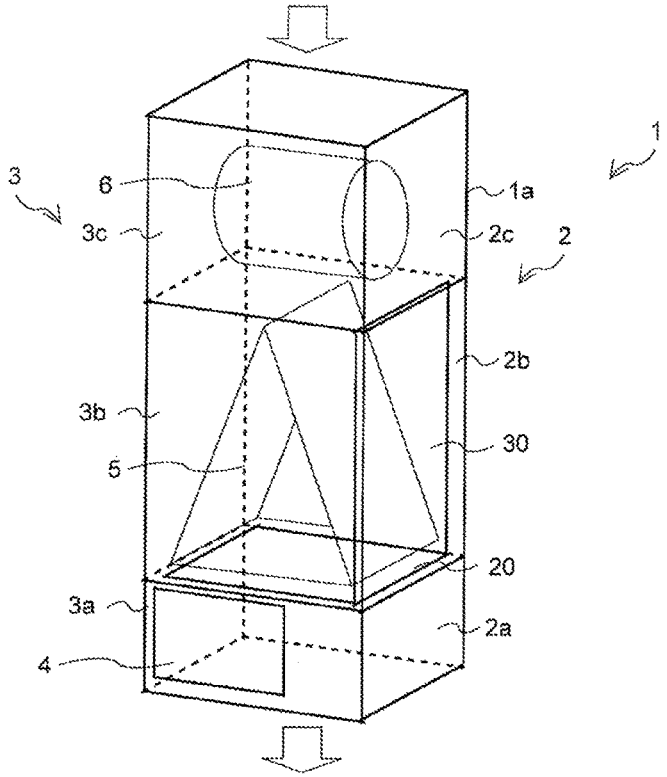
FIG. 23 is a perspective view of the air-conditioning apparatus 1 according to Embodiment 1 of the present invention.
Figure 24:
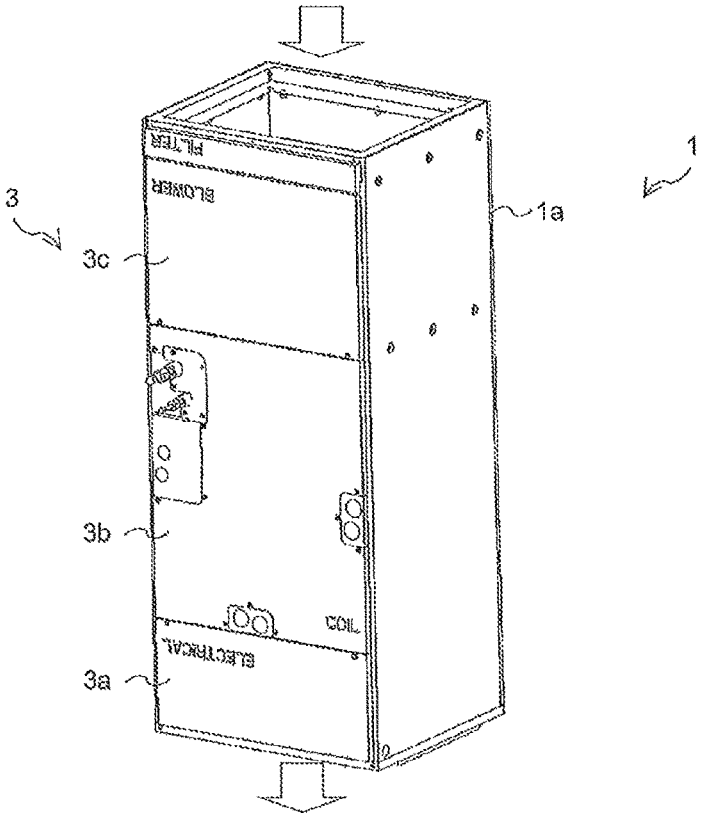
FIG. 24 is a perspective view of the air-conditioning apparatus 1 according to Embodiment 1 of the present invention.

Next, installation forms of the air-conditioning apparatus 1 according to Embodiment 1 of the present invention are described. FIGS. 17 and 18 are perspective views of the air-conditioning apparatus 1 according to Embodiment 1 of the present invention, illustrating an upward blowing installation form in the case where the wind direction is upward blowing. FIGS. 19 and 20 are perspective views of the air-conditioning apparatus 1 according to Embodiment 1 of the present invention, illustrating a rightward blowing installation form in the case where the wind direction is a rightward blowing out of horizontal wind directions. FIGS. 21 and 22 are perspective views of the air-conditioning apparatus 1 according to Embodiment 1 of the present invention, illustrating a leftward blowing installation form in the case where the wind direction is a leftward blowing out of the horizontal wind directions. FIGS. 23 and 24 are perspective views of the air-conditioning apparatus 1 according to Embodiment 1 of the present invention, illustrating a downward blowing installation form in the case where the wind direction is downward blowing. The installation form of the air-conditioning apparatus 1 according to Embodiment 1 of the present invention is changed by changing the placement surface when the air-conditioning apparatus 1 is placed on the floor. For the air-conditioning apparatus 1, wind blowing directions are considered. The placement surface placed on the floor is changed in accordance with the wind direction when the wind direction is, for example, the upward blowing, the rightward blowing, the leftward blowing, or the downward blowing. Here, the rightward blowing and the leftward blowing are wind directions viewed from the door 3 side of the housing 1*a*.

As illustrated in FIGS. 17 and 18, the air-conditioning apparatus 1 is installed such that, when the wind direction is the upward blowing, the first chamber 2*a* is located on the upper side and the third chamber 2*c* is located on the lower side. This upward blowing installation form is a standard installation form of the air-conditioning apparatus 1. In this case, the air is sucked from a lower portion of the housing 1*a* by the air-sending unit 6 and sent to the heat exchange unit 5. Then, the air is subjected to heat exchange with the refrigerant by using the heat exchange unit 5, and after that, blown out from an upper portion of the housing 1*a*. In the heat exchange unit 5, water droplets falling from the heat exchanger 10 are received by the first drain pan 20 and drained.

As illustrated in FIGS. 19 and 20, the air-conditioning apparatus 1 is installed such that, when the wind direction is the rightward blowing, the first chamber 2*a* is located on the right side and the third chamber 2*c* is located on the left side. In this case, the air is sucked from the lower portion of the housing 1*a*, that is, the left side by the air-sending unit 6 and sent to the heat exchange unit 5. Then, the air is subjected to heat exchange with the refrigerant by using the heat exchange unit 5, and after that, blown out from an upper portion of the housing 1*a*, that is, the right side. The second drain pan 30 is attached to the first drain pan 20 as illustrated in FIG. 15 in the heat exchange unit 5. Thus, water droplets falling from the heat exchanger 10 are received by the second drain pan 30 and drained.

As illustrated in FIGS. 21 and 22, the air-conditioning apparatus 1 is installed such that, when the wind direction is the leftward blowing, the first chamber 2*a* is located on the left side and the third chamber 2*c* is located on the right side. The second drain pan 30 is detached and reattached in the heat exchange unit 5 from a state of FIG. 15 to a state of FIG. 16. Thus, when the air flow direction is changed, the second drain pan 30 detachably attached to the one side portion of the first drain pan 20 is attached to the other side portion of the first drain pan 20. Furthermore, the air-sending unit 6 is detached and reattached in the third chamber 2*c* in the horizontally half turned state from a state in the rightward blowing installation form. Thus, an installation direction of the motor 6*a* of the air-sending unit 6 is similar to that in the rightward blowing installation form, that is, the motor shaft is constantly directed upward.

The air is sucked from the lower portion of the housing 1*a*, that is, the right side by the air-sending unit 6 and sent to the heat exchange unit 5. Then, the air is subjected to heat exchange with the refrigerant by using the heat exchange unit 5, and after that, blown out from the upper portion of the housing 1*a*, that is, the left side. The second drain pan 30 is attached to the first drain pan 20 as illustrated in FIG. 16 in the heat exchange unit 5. Thus, water droplets falling from the heat exchanger 10 are received by the second drain pan 30 and drained.

As illustrated in FIGS. 23 and 24, the air-conditioning apparatus 1 is installed such that, when the wind direction is the downward blowing, the first chamber 2*a* is located on the lower side and the third chamber 2*c* is located on the upper side. The heat exchange unit 5 is detached and reattached in the second chamber 2*b* in the vertically inverted state from a state in the upward blowing installation form. Unlike the leftward blowing installation form, it is not required that the second drain pan 30 be detached and reattached for the downward blowing installation form. The air is sucked from the lower portion of the housing 1*a*, that is, the upper side by the air-sending unit 6 and sent to the heat exchange unit 5. Then, the air is subjected to heat exchange with the refrigerant by using the heat exchange unit 5, and after that, blown out from the upper portion of the housing 1*a*, that is, the lower side. In the heat exchange unit 5, water droplets falling from the heat exchanger 10 are received by the first drain pan 20 and drained.

As has been described, the heat exchange unit 5 is installed in the installation state in which the first drain pan 20 is located below the heat exchanger 10 or in the installation state in which the second drain pan 30 is located below the heat exchanger 10. Furthermore, as described above, the first drain pan 20 receives the water droplets falling from the heat exchanger 10 when the one surface of the heat exchanger 10 faces in the gravity direction as in the upward blowing installation form and the downward blowing installation form. In contrast, the second drain pan 30 receives the water droplets falling from the heat exchanger 10 when the other surface of the heat exchanger 10 faces in the gravity direction as in the rightward blowing installation form and the leftward blowing installation form. As has been described, a plurality of installation forms are allowed for the air-conditioning apparatus 1, and for the plurality of installation forms, water drainage performance is ensured with the first drain pan 20 and the second drain pan 30. With the air-conditioning apparatus 1, the water drainage in accordance with the installation forms is performed.

Next, operation of the air-conditioning apparatus 1 according to Embodiment 1 of the present invention is described. The second drain pan 30 of the heat exchange unit 5 includes the rib 31 on the facing surface 30*a* that faces the other surface of the heat exchanger 10. The rear ribs 32 are provided on the rear surface 30*b* that is back side of the facing surface 30*a* of the second drain pan 30 to improve the strength of the second drain pan 30. In this case, bonding of the heat insulating materials to regions where the rear ribs 32 are disposed is avoided. However, when the number of rear ribs 32 provided on the rear surface 30*b* is increased to further improve the strength of the second drain pan 30, the bonding of the heat insulating material or the heat insulating materials to a region or regions where the added rear rib 32 or the added rear ribs 32 are disposed is also avoided. This increases the number of divided insulating materials, thereby degrading work efficiency of the bonding of the heat insulating materials 24.

However, in the air-conditioning apparatus 1 according to Embodiment 1, the rib 31 is provided on the facing surface 30*a* of the second drain pan 30. Thus, it is not required to increase the number of the rear ribs 32. Thus, the work efficiency of the bonding of the heat insulating materials can be improved while the strength of the second drain pan 30 is improved. Furthermore, the rear ribs 32 are disposed at different positions from the rib 31 provided on the facing surface 30*a*. Thus, the strength of the second drain pan 30 is improved in a large area. Furthermore, the rear ribs 32 intersect the rib 31. Thus, the strength of the second drain pan 30 is further improved.

Furthermore, the second drain pan 30 includes the auxiliary ribs 33 that intersect the rib 31. Thus, the strength of the second drain pan 30 is further improved. Furthermore, the second drain pan 30 includes the temporal securing ribs 34. As has been described, the temporal securing ribs 34 indicate positions to which the first drain pan 20 is attached and improve the strength of the second drain pan 30. Furthermore, the second drain pan 30 includes the sheet metal ribs 35. As has been described, the sheet metal ribs 35 allow the first sheet metal 50 to be fitted thereinto and improve the strength of the second drain pan 30. Furthermore, the facing surface 30*a* of the second drain pan 30 is inclined, and the rib 31 is provided along the center line that extends in a highest position of the inclinations of the facing surface 30*a*. Accordingly, the rib 31 does not block the drainage of the water droplets falling on the second drain pan 30 and does not obstruct smooth drainage of water.

REFERENCE SIGNS LIST

1 air-conditioning apparatus 1*a* housing 2 chamber 2*a* first chamber 2*b* second chamber 2*c* third chamber 3 door 3*a* first door 3*b* second door 3*c* third door 4 control unit 4*a* control board 5 heat exchange unit air-sending unit 6*a* motor 6*b* fan 6*c* fan plate 10 heat exchanger 10*a* first heat exchange subunit 10*b* second heat exchange subunit 11 tube heat transfer fin 20 first drain pan 21 first water outlet 22 opening 23 styrene 24 heat insulating material 30 second drain pan 30*a* facing surface 30*b* rear surface 31 rib 32 rear rib 33 auxiliary rib 34 temporal securing rib 35 sheet metal rib 36 second water outlet 37 cut 40 refrigerant pipe 50 first sheet metal 60 second sheet metal 70 attachment sheet metal

The invention claimed is:

1. A heat exchange unit comprising:

a heat exchanger configured to allow heat exchange between air and refrigerant;

a first drain pan provided facing the heat exchanger, the first drain pan having an opening through which the air flows; and a second drain pan provided facing the heat exchanger, wherein the second drain pan is attached to the first drain pan to form an L shape in a side view together with the first drain pan, the heat exchange unit is installed in an installation state in which the first drain pan is located below the heat exchanger or in an installation state in which the second drain pan is located below the heat exchanger, the second drain pan includes a rib on a facing surface of the second drain pan, and wherein the facing surface faces the heat exchanger, and a rear rib disposed on an opposite surface of the second drain pan, where the opposite surface is opposite to the facing surface, and the rear rib is located at a position that is different from a position of the rib when viewed through the second drain pan from a heat exchanger side of the second drain pan.

2. The heat exchange unit of claim 1, wherein, when viewed through the facing surface from the facing surface side, the rear rib of the second drain pan intersects the rib.

3. The heat exchange unit of claim 1, wherein, the facing surface of the second drain pan is inclined, and wherein, in the installation state in which the second drain pan is located below the heat exchanger, the facing surface gradually descends from the rib.

4. The heat exchange unit of claim 3, wherein, in the installation state in which the second drain pan is located below the heat exchanger, the rib of the second drain pan extends toward one direction and is inclined so as to gradually descend, and wherein the second drain pan has a second water outlet provided on a side of the one direction side, the second water outlet allowing a water droplet on the second drain pan to be drained therethrough in the installation state in which the second drain pan is located below the heat exchanger.

5. The heat exchange unit of claim 1, wherein the first drain pan has a rectangular shape and the second drain pan has a rectangular shape, wherein a one side-portion side and an other side-portion side are symmetric with each other in the first drain pan, and a one side-portion side and an other side-portion side are symmetric with each other in the second drain pan, such that one side portion of the second drain pan is detachably attached to one side portion of the first drain pan, and an other side portion of the second drain pan is detachably attached to an other side portion of the first drain pan facing the one side portion of the first drain pan.

6. An air-conditioning apparatus comprising:

a housing;

the heat exchange unit of claim 1, the heat exchange unit being provided in the housing; and an air-sending unit provided in the housing, the air-sending unit sending the air, the housing being configured for installation in the installation state in which the first drain pan is located below the heat exchanger or in the installation state in which the second drain pan is located below the heat exchanger.

7. The air-conditioning apparatus of claim 6, wherein the housing includes a chamber configured to removably house the heat exchange unit and the air-sending unit, and an openable door configured to close the chamber.

8. A heat exchange unit comprising:

a heat exchanger configured to allow heat exchange between air and refrigerant;

a first drain pan provided facing the heat exchanger, the first drain pan having an opening through which the air flows; and a second drain pan provided facing the heat exchanger, wherein the second drain pan is attached to the first drain pan to form an L shape in a side view together with the first drain pan, the heat exchange unit is installed in an installation state in which the first drain pan is located below the heat exchanger or in an installation state in which the second drain pan is located below the heat exchanger, the second drain pan includes:

a rib on a facing surface facing the heat exchanger, and an auxiliary rib intersecting the rib on the facing surface.

9. A heat exchange unit comprising:

a heat exchanger configured to allow heat exchange between air and refrigerant;

a first drain pan provided facing the heat exchanger, the first drain pan having an opening through which the air flows; and a second drain pan provided facing the heat exchanger, wherein the second drain pan is attached to the first drain pan to form an L shape in a side view together with the first drain pan, the heat exchange unit is installed in an installation state in which the first drain pan is located below the heat exchanger or in an installation state in which the second drain pan is located below the heat exchanger, the second drain pan includes:

a rib on a facing surface facing the heat exchanger, and a temporal securing rib on the facing surface, and the temporal securing rib temporarily secures the first drain pan when the second drain pan is attached to the first drain pan.

* * * * *